US005965348A

United States Patent [19]

Toya

[11] Patent Number: 5,965,348

[45] Date of Patent: Oct. 12, 1999

[54] THERMOGRAPHIC MATERIAL

[75] Inventor: Ichizo Toya, Kanagawa, Japan

[73] Assignee: Fuji Photo Film Co., Ltd., Kanagawa, Japan

[21] Appl. No.: 08/857,497

[22] Filed: May 16, 1997

[30] Foreign Application Priority Data

May 23, 1996 [JP] Japan ..... 8-151540

[51] Int. Cl.[6] ..... G03C 1/498

[52] U.S. Cl. ..... 430/620; 430/617; 430/619

[58] Field of Search ..... 430/620, 619, 430/617

[56] References Cited

U.S. PATENT DOCUMENTS 4,291,120 9/1981 Kobayashi et al. ..... 430/620

5,677,121 10/1997 Tsuzuki .

*Primary Examiner*—Thorl Chea

*Attorney, Agent, or Firm*—Birch, Stewart, Kolasch & Birch, LLP

[57] ABSTRACT

In a thermographic material comprising an organic acid silver, the organic acid silver having a half-width of up to 21.0' as measured by X-ray diffractometry is used. Then the thermographic material experiences a minimal change of photographic properties during shelf storage.

11 Claims, No Drawings

THERMOGRAPHIC MATERIAL

BACKGROUND OF THE INVENTION

This invention relates to a thermographic material comprising organic acid silver.

Well known among thermographic materials are black-and-white thermographic materials comprising organic acid silver, which are also known as "dry silver" compositions. Their high black color development is an attractive feature whereas degradation of photographic properties, especially an increase of fog, during shelf storage is a serious problem. Mercury compounds are often used to reduce fog. The use of mercury compounds, however, is undesirable from the safety point of view. Polyhalides are proposed as a substitute, but their effect is still insufficient. There is a need for a means for reducing the fog of organic acid silver itself.

SUMMARY OF THE INVENTION

An object of the present invention is to provide a thermographic material comprising organic acid silver which can maintain photographic properties substantially unchanged during shelf storage.

According to the invention, there is provided a thermographic material comprising at least one organic acid silver having a half-width of up to 21.0' as measured by X-ray diffractometry and preferably a photosensitive silver halide. In one preferred embodiment, at least 80 mol % of the organic acid silver is a silver salt of an organic acid having at least 22 carbon atoms. The organic acid silver is preferably monodisperse.

DETAILED DESCRIPTION OF THE INVENTION

The thermographic material contains an organic acid silver having a half-width of up to 21.0' as measured by X-ray diffractometry. The half-width of X-ray diffraction of organic acid silver is the half-value width of a peak corresponding to a long periodicity structure appearing in an X-ray diffraction pattern as analyzed using a CuKα line source of 50 kV and 180 mA. The value of the narrowest half-width is a representative value which should be not more than 21.0', preferably not more than 18.0'. The lower limit of half-width is about 3'. The peak generally ranges from 5° to 24°, especially from 5° to 8°. Such a value can be measured either in powder state or from a sample coated on a support.

The organic acid silver used herein may be prepared by any desired method as long as its half-width of X-ray diffraction is controlled within the desired range. Preferred is a double salt method in which (i) agitation is done at a ultrahigh speed during neutralization of an organic acid or (ii) the neutralized organic acid is converted into a silver salt as briefly as possible.

Use of an organic acid silver having such a half-width prevents a thermographic material from increasing fog during shelf storage. Satisfactory photographic properties are maintained even at the end of shelf storage. In contrast, an organic acid silver having a half-width of more than 21.0' allows for fog increase during shelf storage.

The organic acid silver which can be used herein may take any desired shape although needle crystals having a minor axis and a major axis are preferred. The organic acid silver must have a smaller grain size from the standpoint of haze. In the practice of the invention, organic acid silver grains should preferably have an average length of a minor axis of 0.01 μm to 0.20 μm, more preferably 0.01 μm to 0.15 μm and an average length of a major axis of 0.10 μm to 5.0 μm, more preferably 0.10 μm to 4.0 μm. The grain size distribution of organic acid silver is desirably monodisperse. The monodisperse distribution means that a standard deviation of the length of minor and major axes divided by the length, respectively, expressed in percent, that is, a coefficient of variation is preferably up to 100%, more preferably up to 80%, most preferably up to 50%. The shape of organic acid silver grains can be determined using an image of an organic acid silver dispersion taken through a transmission electron microscope.

The organic acid silver used herein is a silver salt which is relatively stable to light, but forms a silver image when heated at 80° C. or higher in the presence of an exposed photocatalyst (as typified by a latent image of photosensitive silver halide) and a reducing agent. The organic acid silver may be of any desired organic compound containing a source capable of reducing silver ion. Preferred are silver salts of organic acids, typically long chain aliphatic carboxylic acids having 10 to 30 carbon atoms, especially 22 to 28 carbon atoms. A silver-providing substance is preferably used in an amount of about 5 to 30% by weight of an image forming layer. Preferred organic acid silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Preferably at least 80 mol % of the organic acid silver is a silver salt of an organic acid having at least 22 carbon atoms, more specifically 22 to 30 carbon atoms, especially 22 to 28 carbon atoms. More preferably at least 90 mol % of the organic acid silver is a silver salt of an organic acid having at least 22 carbon atoms.

The organic acid silver may be used alone or in admixture of two or more, preferably in such an amount as to provide a coverage of 0.1 to 5 grams, especially 1 to 3 grams per square meter of the thermographic material.

The organic acid silver may be used in combination with another organic silver salt to be described later. In this case, the organic acid silver should preferably constitute at least 50 mol %, especially at least 80 mol % of the entire organic silver salt.

In the thermographic material of the invention, a photosensitive silver halide is preferably contained along with the organic acid silver.

A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is up to 0.4 μm, preferably 0.01 μm to 0.1 μm, most preferably 0.01 μm to 0.08 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of silver halide grains. Preferably silver halide grains have a high proportion of {100} plane featuring high spectral sensitization efficiency upon adsorption of a spectral sensitizing dye. The proportion of {100} plane is preferably at least 50%, more preferably at least 65%, most preferably at least 80%. Note that the proportion of Miller index {100} plane can be determined by the method described in T. Tani, J. Imaging Sci., 29, 165 (1985), utilizing the adsorption dependency of {111} plane and {100} plane upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. An appropriate content of the metal complex is $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. Preferred among cobalt and iron complexes are hexacyano metal complexes. Illustrative, non-limiting examples of cobalt and iron complexes include hexacyano metal complexes such as $[Fe(CN)_6]^{4-}$, $[Fe(CN)_6]^{3-}$, and $[Co(CN)_6]^{3-}$. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt (typically organic acid silver). With respect to a method and conditions of admixing the separately prepared photosensitive silver halide and organic silver salt (typically organic acid silver), there may be used a method of admixing the separately prepared photosensitive silver halide and organic silver salt (typically organic acid silver) in a high speed agitator, ball mill, sand mill, colloidal mill, vibratory mill or homogenizer or a method of preparing an organic silver salt by adding a preformed photosensitive silver halide at any timing during preparation of an organic silver salt. Any desired mixing method may be used insofar as the benefits of the invention are fully achievable.

In the practice of the invention, silver salts of compounds having a mercapto or thion group and derivatives thereof may also be used as the organic silver salt along with the organic acid silver. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thion as described in U.S. Pat. No. 3,301,768. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in UKP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

In the photosensitive emulsion layer, polyhydric alcohols, e.g., glycerin and diols as described in U.S. Pat. No. 2,960,404, fatty acids and esters thereof as described in U.S. Pat. Nos. 2,588,765 and 3,121,060, and silicone resins as described in UKP 955,061 may be added as a plasticizer and lubricant.

According to the invention, a hardener may be used in various layers including a photosensitive emulsion layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

In the practice of the invention, a surfactant may be used for the purposes of improving coating and electric charging properties. The surfactant used herein may be nonionic, anionic or cationic or a fluorinated one. Examples include fluorinated polymer surfactants as described in JP-A 170950/1987 and U.S. Pat. No. 5,382,504, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994.

A sensitizing dye is also useful in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein.

It is advantageous to select a sensitizing dye having appropriate spectral sensitivity to the spectral properties of a particular light source of various laser imagers, scanners, image setters and printing plate-forming cameras. Exemplary dyes for spectral sensitization to red light include compounds I-1 to I-38 described in JP-A 18726/1979, compounds I-1 to I-35 described in JP-A 75322/1994, and compounds I-1 to 1-34 described in JP-A 287338/1995 for He—Ne laser light sources and dyes 1 to 20 described in JP-B 39818/1980, compounds I-1 to I-37 described in JP-A 284343/1987, and compounds I-1 to I-34 described in JP-A 287338/1995 for LED light sources.

In particular, silver halide grains are spectrally sensitized at any wavelength region in the range of 750 to 1,400 nm. More specifically, photosensitive silver halide can be spectrally advantageously sensitized with various known dyes including cyanine, merocyanine, styryl, hemicyanine, oxonol, hemioxonol and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, UKP 1,466,201, 1,469,117, and 1,422,057, JP-B 10391/1991 and 52387/1994, JP-A 341432/1993, 194781/1994, and 301141/1994. Especially preferred dye structures are cyanine dyes having a thioether bond, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, and Publication of International Patent Application No. 500926/1995.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dyes may be used in admixture of two or more in the practice of the invention. The sensitizing dye is added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoro-propanol, 2,2,2-trifluoroethanol, 3-methoxy-1-propanol, 3-methoxy-1-butanol, 1-methoxy-2-propanol, N,N-dimethyl-formamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to a solution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly higher amount of about 2 to 15% by weight of that layer.

For thermographic materials using organic silver salts, a wide range of reducing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones.

In the thermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—SM and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

Hydrazine derivatives may be used in the present invention. Typical hydrazine derivatives used herein are compounds of the general formula (I) described in Japanese Patent Application No. 47961/1994, specifically compounds I-1 to I-53 described therein.

Other hydrazine derivatives are also preferred. Exemplary hydrazine derivatives include the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; and the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (1) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intramolecular hydrogen bond with the hydrogen atom of hydrazine described in Japanese Patent Application No. 191007/1995, specifically the compounds of the general formulae (A), (B), (C), (D), (E), and (F), more specifically compounds N-1 to N-30 described therein; and the compounds of the general formula (1) in Japanese Patent Application No. 191007/1995, more specifically compounds D-1 to D-55 described therein.

Hydrazine nucleating agents are used by dissolving in suitable water-miscible organic solvents such as alcohols (e.g., methanol, ethanol, propanol, and fluorinated alcohols), ketones (e.g., aetone and methyl ethyl ketone), dimethylformamide, dimethylsulfoxide, and methyl cellosolve.

An appropriate amount of hydrazine nucleating agent is 1 $\mu$mol to 10 mmol, more preferably 10 $\mu$mol to 5 mmol, most preferably 20 $\mu$mol to 5 mmol per mol of silver halide.

According to the invention, the thermographic emulsion may be coated on a variety of supports. Typical supports include polyester films such as polyethylene terephthalate (PET) film and polyethylene naphthalate film, subbed polyester film, cellulose nitrate film, cellulose ester film, poly (vinyl acetal) film, polycarbonate film and related or resinous materials, as well as glass and the like.

One commonly used method for preparing a PET film includes extruding a melt through a die, quenching the film for solidification, stretching the film in a longitudinal direction by a factor of 3.0 to 5.0 and then in a transverse direction by a factor of 2.5 to 4.5 and optionally in a longitudinal direction again by a factor of 1.1 to 2.5, and heat setting the film. When it is desired to provide dimensional stability in the transverse direction, heat setting is done while limiting contraction in the transverse direction. This method is truly successful in improving the dimensional stability of film in the transverse direction. It is preferred to add a heat treatment step for relaxation at the end of heat setting in order to provide dimensional stability in the longitudinal direction. In this step, the tension applied to the running film is made as low as possible as described in U.S. Pat. Nos. 2,779,684 and 3,526,695 and JP-A 64571/1976, for example.

Also the support can be doped with a dyestuff. Specifically, a dyestuff is added upon preparation of a support. The dyestuff can be added by well-known techniques such as dry blending and melt mixing. A careful control of temperature and time is needed for a thermally discolorable dyestuff.

The supports are preferably transparent.

The thermographic material of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the thermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the thermographic emulsion can be coated by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and UKP 837,095.

In the thermographic material of the invention, there may be contained additional layers, for example, a dye accepting layer for accepting a mobile dye image, an opacifying layer when reflection printing is desired, a protective topcoat layer, and a primer layer well known in the photothermographic art. The thermographic material of the invention is preferably such that only a single sheet of the thermographic material can form an image. That is, it is preferred that a functional layer necessary to form an image such as an image receiving layer does not constitute a separate member.

A surface protective layer may be provided in the thermographic material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used light absorbing substances and filter dyes as described in U.S. Pat. Nos. 3,253,921, 2,274,782, 2,527,583, and 2,956,879. The dyestuffs may be mordanted as described in U.S. Pat. No. 3,282,699.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion surface may have any degree of matte insofar as no star dust failures occur although a Bekk smoothness of 500 to 10,000 seconds, especially 1,000 to 10,000 seconds is preferred.

The emulsion layer is based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

It is sometimes advantageous to use an additive known as a "toner" for improving images in addition to the above-mentioned components. The toner is used in an amount of 0.1 to 10% by weight of the entire silver-carrying components. The toners are compounds well known in the photographic art as shown in U.S. Pat. Nos. 3,080,254, 3,847,612 and 4,123,282.

Examples of the toner include phthalimide and N-hydroxyphthalimide; cyclic imides such as succinimide, pyrazoline-5-ones, quinazoline, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl) phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(1-naphthyl) phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asymtriazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The thermographic material of the present invention is preferably a one side photosensitive material having at least one photosensitive layer containing a silver halide emulsion on one surface of a support and a back layer on the other surface.

In the present invention, a matte agent may be added to the one side photosensitive material for improving transportation. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 $\mu$m to 30 $\mu$m are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

In the practice of the invention, the binder used in the back layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methy methacrylate), polyvinyl chloride, poly(methacrylic acid), copoly(styrene-maleic anhydride), copoly(styrene-acrylonitrile), copoly (styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water to form a dispersion which is coated to form a layer.

Where anti-halation dyestuffs are used in the practice of the invention, such a dyestuff may be any compound which has desired absorption, exhibits sufficiently low absorption in the visible region and provides the backing layer with a preferred absorbance spectrum profile. Exemplary anti-halation dyes are the compounds described in JP-A 13295/1995, U.S. Pat. No. 5,380,635, JP-A 68539/1990, page 13, lower-left column to page 14, lower-left column, and JP-A 24539/1991, page 14, lower-left column to page 16, lower-right column though not limited thereto.

A backside resistive heating layer as described in U.S. Pat. Nos. 4,460,681 and 4,374,921 may be used in a thermographic imaging system according to the present invention.

EXAMPLE

Examples of the present invention are given below by way of illustration and not by way of limitation.

The trade names used in Examples have the following meaning.

Butvar B-76: polyvinyl butyral by Monsanto Co.

CAB 171-15S and 381-20: cellulose acetate butyrate by Eastman Chemical Products, Inc.

Denka Butyral: polyvinyl butyral by Denki Kagaku Kogyo K.K.

Megafax F-176P: fluorinated surfactant by Dai-Nihon Ink Chemical Industry K.K.

Sildex: spherical silica by Dokai Chemical K.K.

Sumidur N3500: polyisocyanate by Sumitomo-Bayern Urethane K.K.

Example 1

Preparation of Silver Halide Grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing 10 μmol/liter of dipotassium hexachloroiridate and 1 mol/liter of potassium bromide were added over 30 minutes by a controlled double jet method while maintaining the solution at pAg 7.7. The pH of the solution was lowered to cause flocculation and sedimentation for desalting. The solution was adjusted to pH 5.9 and pAg 8.2 by adding 0.15 gram of phenoxyethanol. There were obtained silver iodobromide grains in the form of cubic grains having an iodine content of 8 mol % in the core and 2 mol % on the average, a mean grain size of 0.05 μm, a coefficient of variation of projected area of 8%, and a (100) plane proportion of 88%.

The thus obtained silver halide grains were heated at 60° C., to which 85 μmol of sodium thiosulfate, 11 μmol of 2,3,4,5,6-pentafluorophenyldiphenylphosphine selenide, 15 μmol of tellurium compound 1, 3.0 μmol of chloroauric acid, and 260 μmol of thiocyanic acid were added per mol of silver. The solution was ripened for 120 minutes and quenched to 30° C., obtaining a silver halide emulsion.

Preparation of Organic Acid Silver Emulsion A

To 950 ml of water was added 42.4 grams of an organic acid mixture consisting of behenic acid and stearic acid in a molar ratio of 85/15. The organic acids were dissolved by heating at 90° C. With stirring at a moderate speed, 186.6 ml of 1N NaOH aqueous solution was added and after 30 minutes, 64.7 ml of 1N nitric acid was added. With stirring, the temperature was lowered to 50° C. and 0.625 grams of N-bromosuccinimide was added. Thereafter, the silver halide emulsion was added in such an amount as to give 12.4 mmol of silver halide, 124.4 ml of a 17% aqueous solution of silver nitrate was added over 2 minutes, and stirring was continued for a further 20 minutes. Thereafter, with stirring, 150 grams of a 1.2 wt % n-butyl acetate solution of polyvinyl acetate was slowly added to the aqueous mixture. With stirring stopped, the reaction solution was allowed to stand whereupon the solids in the aqueous mixture migrated to the oil layer. The aqueous layer was removed together with the salts contained therein. The oil layer was repeatedly washed with water until the water filtrate reached a conductivity of 35 μS/cm or less. After thorough removal of water from the oil layer, 80 grams of a 2.5 wt % MEK solution of polyvinyl butyral (Denka Butyral #3000-K) was added to the oil layer. The mixture was fully agitated for dissolving the oily layer. A mixture of 0.56 mmol of pyridinium bromide perbromide and 0.8 mmol of calcium bromide in 3 grams of methanol was added, and 194 grams of MEK and 57 grams of polyvinyl butyral (Butvar B-76) were then added to the mixture, which was dispersed to yield a mix emulsion A of organic acid silver and silver halide. Upon electronmicroscopic observation, the mix emulsion contained needle organic acid silver grains having a mean minor diameter of 0.05 μm, a mean major diameter of 1.3 μm and a coefficient of variation of 34%.

Preparation of Organic Acid Silver Emulsions B and C

Emulsions B and C were prepared by the same procedure as emulsion A except for the speed of agitation upon sodium addition. Agitation at a high speed yielded an emulsion B containing needle organic acid silver grains having a mean minor diameter of 0.05 μm, a mean major diameter of 1.2 μm and a coefficient of variation of 30%. Agitation at a very high speed yielded an emulsion C containing needle organic acid silver grains having a mean minor diameter of 0.05 μm, a mean major diameter of 1.2 μm and a coefficient of variation of 29%.

Preparation of Emulsion Layer Coating Solution

Various chemicals were added to the above-prepared organic acid silver emulsion in amounts per mol of silver. With stirring at 25° C., 10 mg of sodium phenylthiosulfonate, 70 mg of coloring matter 1, 30 mg of coloring matter 2, 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 8 grams of 5-tribromomethylsulfonyl-2-methylthiadiazole, 6 grams of 2-tribromomethylsulfonylbenzothiazole, 5 grams of 4,6-ditrichloromethyl-2-phenyltriazine, 2 grams of disulfide compound 1, 155 grams of 1,1-bis(2-hydroxy-3,5-dimethylphenyl)-3,5,5-trimethylhexane, 4.5 grams of tetrachlorophthalic acid, 1.1 grams of Megafax F-176P, 590 grams of 2-butanone and 10 grams of methyl isobutyl ketone.

Emulsion Surface Protective Layer Coating Solution

A coating solution was prepared by dissolving 75 grams of CAB 171-15S, 5.7 grams of 4-methylphthalic acid, 1.5 grams of tetrachlorophthalic anhydride, 12.5 grams of phthalazine, 0.3 gram of Megafax F-176P, 2 grams of Sildex H31 (spherical silica having a mean particle size of 3 μm), and 6 grams of Sumidur N3500 in 3,070 grams of 2-butanone and 30 grams of ethyl acetate.

Back Layer Coating Solution

Calcium compound 1 was synthesized by adding 167 ml of an aqueous solution containing 0.019 mol of calcium chloride and 125 ml of 25% aqueous ammonia to 1 liter of an ethanol solution containing 0.08 mol of 3,5-di-tert-butylcatechol, and blowing air into the solution for 3 hours at room temperature. There were precipitated crystals of bis[2-(3,5-di-tert-butyl-o-benzoquinonemonoimine)-4,6-di-tert-butylphenolato]calcium (II).

A back layer coating solution was prepared by adding 12 grams of polyvinyl butyral (Denka Butyral #4000-2), 12 grams of CAB 381-20, 300 mg of calcium compound 1, 120 mg of dyestuff 1, 350 mg of dyestuff 2, 5 mg of dyestuff 3, 0.4 gram of Sildex H121 (spherical silica having a mean particle size 12 ||m), 0.4 gram of Sildex H51 (spherical silica having a mean particle size 5 μm), 0.1 gram of Megafax F-176P, and 2 grams of Sumidur N3500 to 500 grams of 2-butanone and 500 grams of 2-propanol and stirring the mixture for dissolving the components.

Preparation of Coated Sample

The emulsion layer coating solution prepared above was coated to one surface of a 175-μm thick polyethylene terephthalate support blue tinted with dyestuff 2 so as to provide an overall coverage of 2.3 g/m$^2$ of silver. The back layer coating solution was then coated on the opposite surface of the support to a dry thickness of 3 μm. Further, the emulsion surface protective layer coating solution was coated onto the emulsion layer to a dry thickness of 2 μm. The thus obtained photosensitive material has a surface smoothness expressed by a Bekk smoothness of 1,000 seconds on the emulsion surface and 80 seconds on the back surface as measured by the Oken type smoothness measurement described in J. TAPPI, Paper Pulp Test No. 5.

The tellurium compound 1, disulfide compound 1, coloring matters 1 and 2, dyestuffs 1, 2 and 3 have the structures shown below.

tellurium compound 1

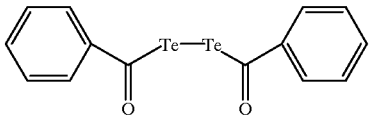

disulfide compound 1

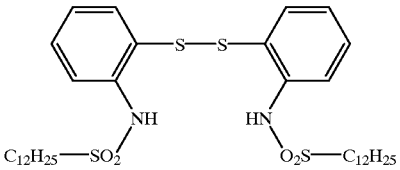

coloring matter 1

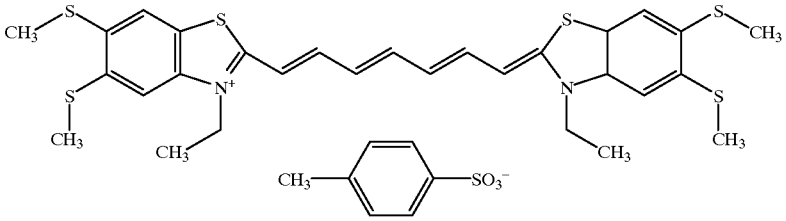

coloring matter 2

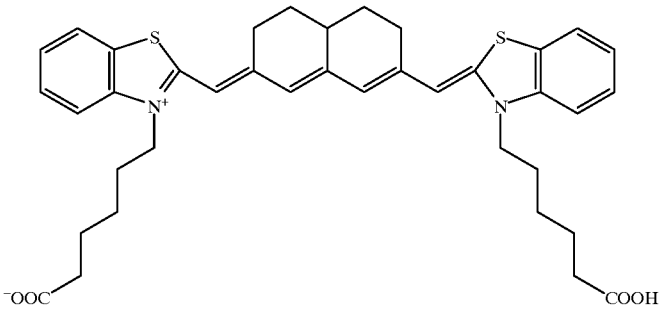

dyestuff 1

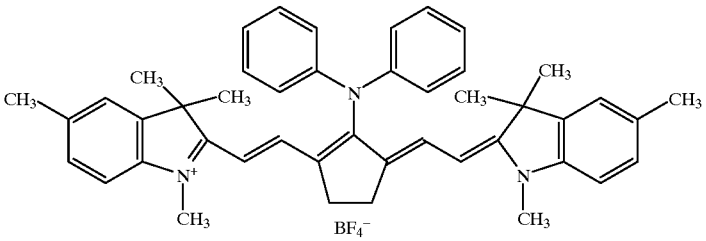

-continued dyestuff 2

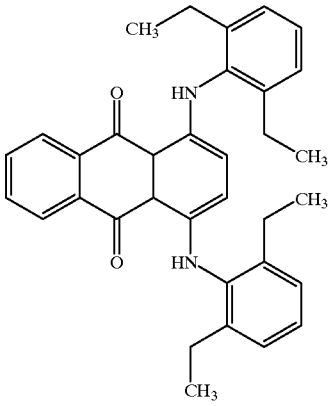

dyestuff 3

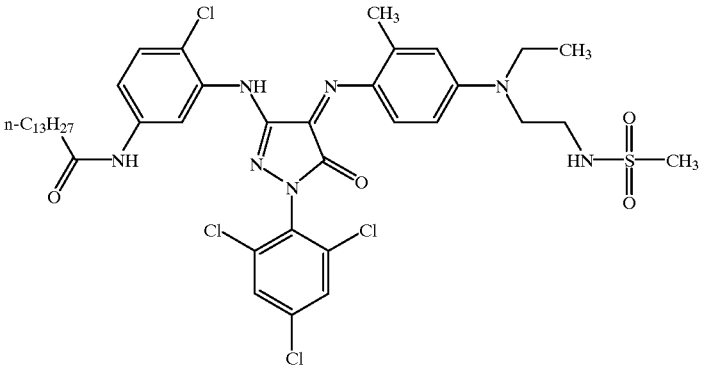

Half-Width Measurement

An X-ray diffraction peak was measured by irradiating a CuKα line at 50 kV and 180 mA to a photosensitive material in the form of a coated sample. Peaks corresponding to a long periodicity structure of organic acid silver was selected from diffraction peaks and the value of the narrowest half-width among them was regarded a representative value.

Sensitometry (1) Fog of Fresh Sample

The above-prepared photosensitive material on the emulsion layer side was subject to laser scanning exposure by means of an exposure apparatus having a semiconductor laser of wavelength 810 nm as a light source. The exposure laser light was emitted in the longitudinal multiple mode by a high frequency superposition technique. After exposure, the photosensitive material was developed by heating on a heat drum at 120° C. for 20 seconds. The developed material was measured for fog.

(2) Fog of Aged Sample

Fog was measured as in (1) except that the photosensitive material was allowed to stand for one month at 35° C. before measurement.

(3) Fog Difference (Δfog) Before and After Aging

The difference of fog between the fresh and aged samples was determined from the fog values obtained in (1) and (2).

$$\Delta fog = |(\text{fresh sample fog}) - (\text{aged sample fog})|$$

Table 1 shows Δfog as well as the type of organic acid silver emulsion, preparation conditions thereof, a selected peak of a long periodicity structure of organic acid silver and half-width thereof.

TABLE 1

| Photo-sensitive material | Agitation speed upon Na addition | Organic acid silver emulsion | Selected peak of long periodicity structure | Half-width | Δfog |
|---|---|---|---|---|---|
| 1* | medium | A | 5.9° | 26.2' | 0.3 |
| 2 | high | B | 6.0° | 19.8' | 0.08 |
| 3 | very high | C | 6.0° | 14.7' | 0.05 |

*comparison

As seen from Table 1, photosensitive materials within the scope of the invention experience little change of photographic properties during shelf storage. For the three photosensitive materials, fresh samples showed fog values within the acceptable level.

Example 2

Emulsions D and E were prepared by the same procedure as emulsion A in Example 1 except for the time duration from the end of sodium addition to the start of silver salt formation. A duration of 15 minutes yielded an emulsion D containing needle organic acid silver grains having a mean minor diameter of 0.05 μm, a mean major diameter of 1.3 μm and a coefficient of variation of 34%. A duration of 5 minutes yielded an emulsion E containing needle organic acid silver grains having a mean minor diameter of 0.05 μm, a mean major diameter of 1.3 μm and a coefficient of variation of 33%.

Using emulsions A, D and E, photosensitive materials were prepared as in Example 1. They were similarly examined.

The results are shown in Table 2.

TABLE 2

| Photo-sensitive material | Duration from Na addition to Ag salt formation | Organic acid silver emulsion | Selected peak of long periodicity structure | Half-width | Δfog |
|---|---|---|---|---|---|
| 21* | 30 min. | A | 5.8° | 26.2' | 0.3 |
| 22 | 15 min. | D | 5.9° | 20.4' | 0.09 |
| 23 | 5 min. | E | 6.0° | 18.8' | 0.07 |

*comparison

As seen from Table 2, photosensitive materials within the scope of the invention experience little change of photographic properties during shelf storage. For the three photosensitive materials, fresh samples showed fog values within the acceptable level.

Example 3

Preparation of Organic Acid Silver Emulsions F and G

Emulsions F and G were prepared by the same procedure as emulsion C in Example 1 except for the molar ratio of behenic acid/stearic acid. A molar ratio of behenic acid/stearic acid of 70/30 yielded an emulsion F containing needle organic acid silver grains having a mean minor diameter of 0.06 μm, a mean major diameter of 1.4 μm and a coefficient of variation of 57%. A molar ratio of behenic acid/stearic acid of 100/0 yielded an emulsion G containing needle organic acid silver grains having a mean minor diameter of 0.04 μm, a mean major diameter of 1.2 μm and a coefficient of variation of 27%.

Preparation of Emulsion Layer Coating Solution

Various chemicals were added to the above-prepared organic acid silver emulsion in amounts per mol of silver. With stirring at 25° C., 10 mg of sodium phenylthiosulfonate, 70 mg of coloring matter 3, 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 8 grams of 5-tribromomethylsulfonyl-2-methylthiadiazole, 6 grams of 2-tribromomethylsulfonylbenzothiazole, 5 grams of 4,6-ditrichloromethyl-2-phenyltriazine, 2 grams of disulfide compound 1, 155 grams of 1,1-bis(2-hydroxy-3,5-dimethylphenyl)-3,5,5-trimethylhexane, 4.5 grams of tetrachlorophthalic acid, 1.1 grams of Megafax F-176P, 590 grams of 2-butanone and 10 grams of methyl isobutyl ketone.

Emulsion Surface Protective Layer Coating Solution

A coating solution was prepared by dissolving 75 grams of CAB 171-15S, 5.7 grams of 4-methylphthalic acid, 1.5 grams of tetrachlorophthalic anhydride, 12.5 grams of phthalazine, 0.3 gram of Megafax F-176P, 2 grams of Sildex H31 (spherical silica having a mean particle size of 3 μm), and 6 grams of Sumidur N3500 in 3,070 grams of 2-butanone and 30 grams of ethyl acetate.

Back Layer Coating Solution

Calcium compound 1 was synthesized by adding 167 ml of an aqueous solution containing 0.019 mol of calcium chloride and 125 ml of 25% aqueous ammonia to 1 liter of an ethanol solution containing 0.08 mol of 3,5-di-tert-butylcatechol, and blowing air into the solution for 3 hours at room temperature. There were precipitated crystals of bis[2-(3,5-di-tert-butyl-o-benzoquinonemonoimine)-4,6-di-tert-butylphenolato]calcium (II).

A back layer coating solution was prepared by adding 12 grams of polyvinyl butyral (Denka Butyral #4000-2), 12 grams of CAB 381-20, 300 mg of calcium compound 1, 120 mg of dyestuff 4, 350 mg of dyestuff 2, 5 mg of dyestuff 3, 0.4 gram of Sildex H121 (spherical silica having a mean particle size 12 μm), 0.4 gram of Sildex H51 (spherical silica having a mean particle size 5 μm), 0.1 gram of Megafax F-176P, and 2 grams of Sumidur N3500 to 500 grams of 2-butanone and 500 grams of 2-propanol and stirring the mixture for dissolving the components.

Preparation of Coated Sample

The emulsion layer coating solution prepared above was coated to one surface of a 175-μm thick polyethylene terephthalate support blue tinted with dyestuff 2 so as to provide an overall coverage of 2.3 g/m$^2$ of silver. The back layer coating solution was then coated on the opposite surface of the support to a dry thickness of 3 μm. Further, the emulsion surface protective layer coating solution was coated onto the emulsion layer to a dry thickness of 2 μm. The thus obtained photosensitive material has a surface smoothness expressed by a Bekk smoothness of 1,000 seconds on the emulsion surface and 80 seconds on the back surface as measured by the Oken type smoothness measurement described in J. TAPPI, Paper Pulp Test No. 5.

The dyestuffs 2 and 3 are as shown in Example 1 and coloring matter 3 and dyestuff 4 have the structures shown below.

coloring matter 3

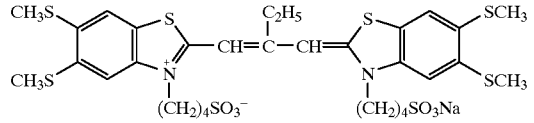

dyestuff 4

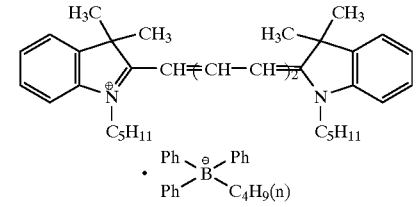

Sensitometry (1) Fog of Fresh Sample

The above-prepared photosensitive material on the emulsion layer side was subject to laser scanning exposure by means of an exposure apparatus having a semiconductor laser of wavelength 635 nm as a light source. The exposure laser light was emitted in the longitudinal multiple mode by a high frequency superposition technique. After exposure, the photosensitive material was developed by heating on a heat drum at 120° C. for 20 seconds. The developed material was measured for fog.

(2) Fog of Aged Sample

Fog was measured as in (1) except that the photosensitive material was allowed to stand for one month at 35° C. before measurement.

(3) Fog Difference (Δfog) Before and After Aging

The difference of fog between the fresh and aged samples was determined as follows.

$$\Delta fog = |(\text{fresh sample fog}) - (\text{aged sample fog})|$$

Table 3 shows Δfog as well as the type of organic acid silver emulsion, behenic acid/stearic acid molar ratio thereof, a selected peak of a long periodicity structure of organic acid silver and half-width thereof.

TABLE 3

| Photo-sensitive material | Behenic acid/ stearic acid ratio | Organic acid silver emulsion | Selected peak of long periodicity structure | Half-width | Δfog |
|---|---|---|---|---|---|
| 31 | 70/30 | F | 5.8° | 20.5' | 0.09 |
| 32 | 85/15 | C | 6.0° | 14.7' | 0.05 |
| 33 | 100/0 | G | 6.0° | 12.8' | 0.04 |

As seen from Table 3, photosensitive materials within the scope of the invention experience little change of photographic properties during shelf storage.

There has been described a thermographic material comprising an organic acid silver having a specific X-ray diffractometric feature which can prevent photographic properties from degrading during shelf storage.

Reasonable modifications and variations are possible from the foregoing disclosure without departing from either the spirit or scope of the present invention as defined by the claims.

I claim:

1. A thermally processable imaging element comprising a support and a thermographic or photothermographic imaging layer comprising at least (a) an organic acid silver, (b) a reducing agent for silver ions, and (c) a binder, wherein said organic acid silver has a half-width of up to 21.0' as measured by X-ray diffractometry.

2. The element of claim 1, wherein the imaging layer is a photothermographic imaging layer further comprising a photosensitive silver halide.

3. The element of claim 1 wherein at least 80 mol % of the organic acid silver is a silver salt of an organic acid having at least 22 carbon atoms.

4. The element of claim 1 wherein the organic acid silver is monodisperse.

5. The element of claim 1 wherein said half-width is not more than 18.0'.

6. The element of claim 1 wherein grains of said organic acid silver have an average length of minor axis of 0.01 μm to 0.20 μm and an average length of major axis of 0.10 μm to 5.0 μm.

7. The element of claim 6 wherein said average length of minor axis is 0.01 μm to 0.15 μm and said average length of major axis is 0.10 μm to 4.0 μm.

8. The element of claim 1 wherein said organic acid silver is contained in such an amount as to provide a coverage of 0.1 to 5 grams per square meter of the element.

9. The element of claim 1, wherein said half-width is from 3' to 18.0'.

10. The element of claim 1, wherein said organic acid silver is present in an amount of 5 to 30% by weight of the image layer.

11. The element of claim 2, wherein the photosensitive silver halide is present in an amount of 0.03 to 0.25 mol per mol of an organic silver salt.

* * * * *